US006227388B1

(12) United States Patent
Borzelleca

(10) Patent No.: US 6,227,388 B1
(45) Date of Patent: May 8, 2001

(54) DISPLAY AND STORAGE SYSTEM

(76) Inventor: Louise Anne Borzelleca, 556 Greenwood Ct., Harleysville, PA (US) 19438

( * ) Notice: Subject to any disclaimer, the term of this patent is extended or adjusted under 35 U.S.C. 154(b) by 0 days.

(21) Appl. No.: 09/560,681

(22) Filed: Apr. 27, 2000

(51) Int. Cl.[7] ..... A47F 7/00

(52) U.S. Cl. ..... 211/88.01; 211/26; 211/1.3; 362/392; 362/393; 362/810

(58) Field of Search ..... 211/88.01, 87.01, 211/88.03, 26, 99, 104, 1.3; 362/810, 392, 393

(56) References Cited

U.S. PATENT DOCUMENTS

| | | | | |
|---|---|---|---|---|
| 1,989,294 | * | 1/1935 | Serpico . | |
| 2,009,965 | * | 7/1935 | Pollock . | |
| 4,468,721 | | 8/1984 | Vandrilla | 362/392 |
| 4,760,509 | | 7/1988 | Panagiotou | 362/285 |
| 4,839,784 | * | 6/1989 | Lin | 362/393 |
| 5,124,903 | * | 6/1992 | Coviello | 362/392 |
| 5,199,781 | | 4/1993 | Sweeny | 362/145 |
| 5,329,437 | | 7/1994 | Briggs | 362/393 |
| 5,407,164 | | 4/1995 | Quinn | 248/316.7 |
| 5,601,360 | | 2/1997 | Paquette | 362/226 |
| 5,829,869 | * | 11/1998 | Clegg et al. | 362/392 |

* cited by examiner

*Primary Examiner*—Robert W. Gibson, Jr.
(74) *Attorney, Agent, or Firm*—Synnestvedt & Lechner LLP

(57) ABSTRACT

A display and storage system for displaying an object in a window and storing the object beneath the window's sill is disclosed. A compartment fitted with an opening and having a bottom and a plurality of side walls is positioned beneath the sill. An aperture is arranged in the sill in registration with the opening providing access to the compartment interior. A movable top is positionable in registration with the aperture to enclose the compartment. A support surface is pivotally mounted within the compartment and is pivotal between a first position oriented angularly with respect to the surface of the sill and a second position co-planar with the sill. An object, such as a candle, is interengagable with the support surface for display in the window when the surface is in the co-planar position.

17 Claims, 8 Drawing Sheets

FIG.3
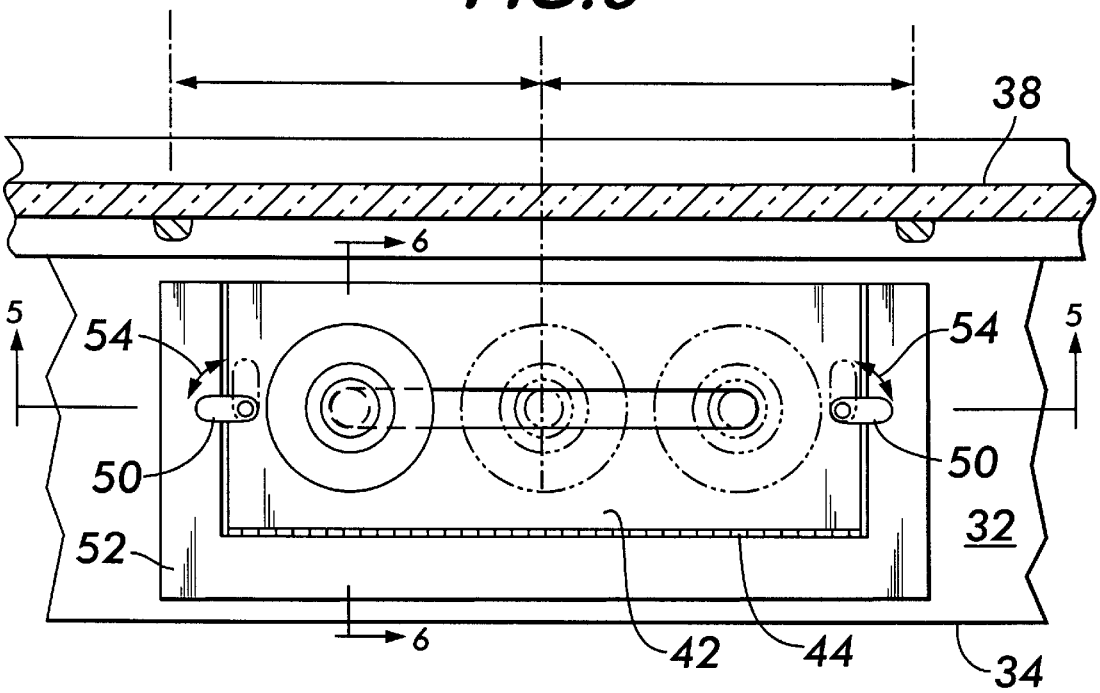
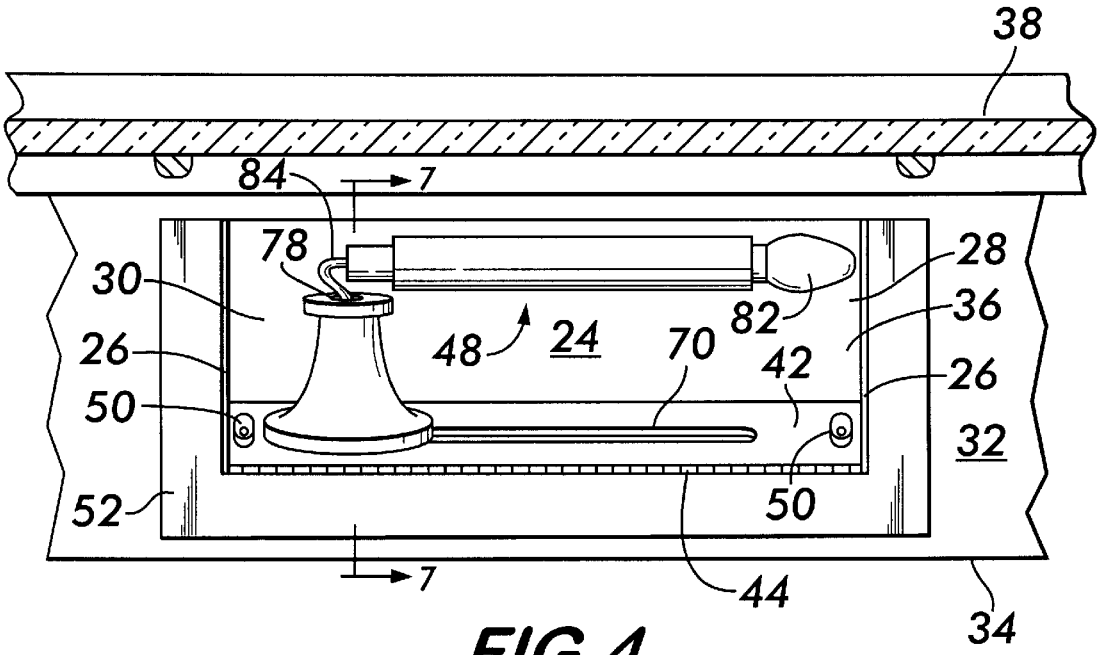
FIG.4

FIG.10
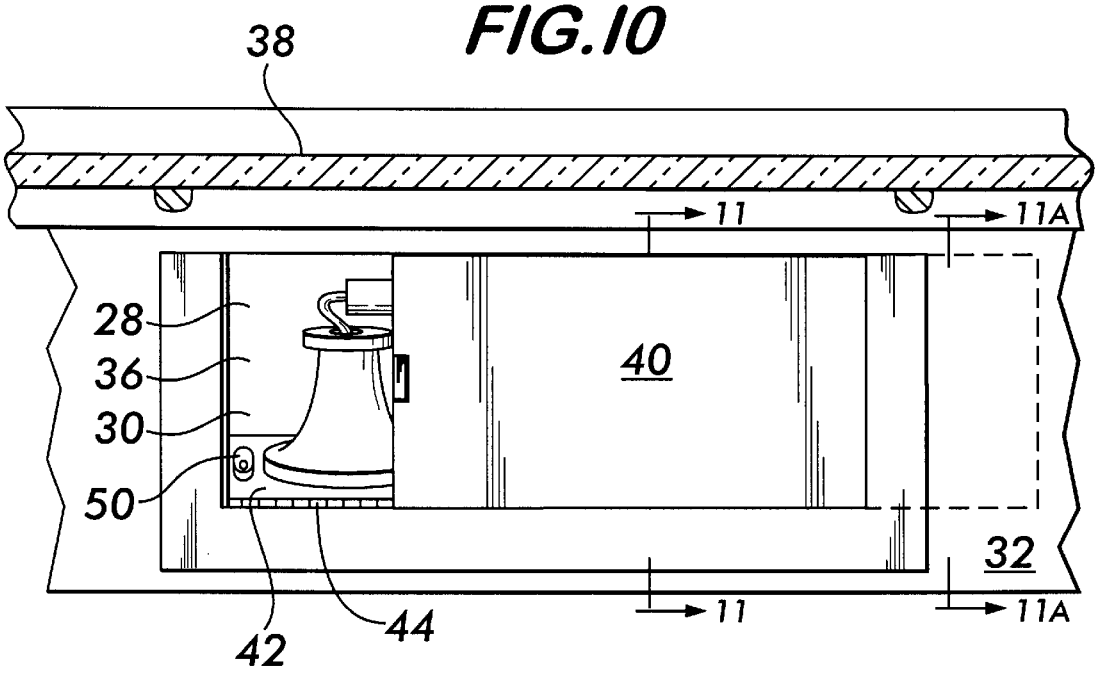
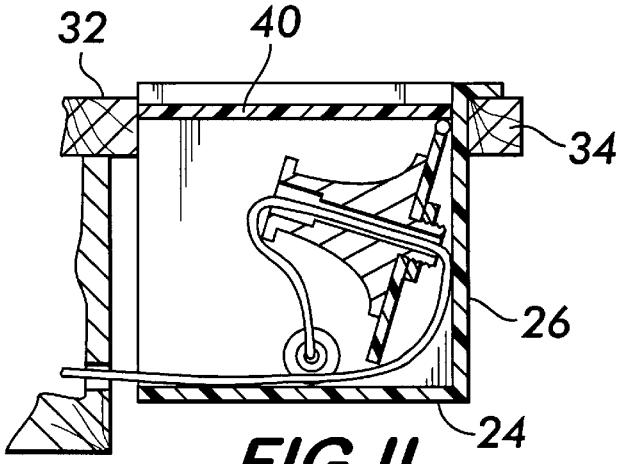
FIG.11
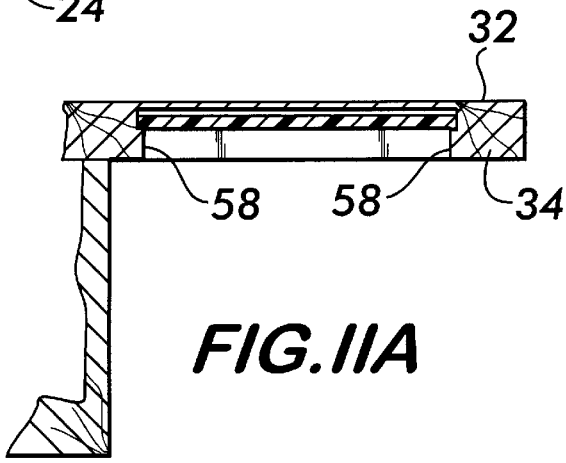
FIG.11A

DISPLAY AND STORAGE SYSTEM

FIELD OF THE INVENTION

This invention relates to a device allowing objects being displayed in a window to be conveniently stored beneath the window's sill, the device being particularly applicable for use with decorative objects such as candles.

BACKGROUND OF THE INVENTION

Objects are often displayed in the windows of homes, offices and businesses for a variety of purposes, for example, as decorations to celebrate a holiday, symbols to commemorate a special or solemn occasion or to promote a product for sale.

The same items are often repeatedly displayed every year for a recurring holiday or event. For example, it is customary to display candles, including both traditional and electric types, in the windows of homes to celebrate the Christmas season.

It can be inconvenient, however, to retrieve the candles or other ornaments or objects from storage, for example, in a basement or attic, set them up for display in the windows of a home and then later break down the display and again place the candles back into storage. In the display of electric candles, there is the further problem of unsightly electrical cords extending between each candle and a nearby electrical outlet. In view of the fact that the same objects may be displayed in the same windows year after year, there is a need for a system to more conveniently store the objects nearer to their point of display, so that they can be more readily retrieved and set up for display in the window and then later broken down and conveniently returned to storage.

SUMMARY AND OBJECTS OF THE INVENTION

The invention is a display and storage system for displaying an object in a window and storing the object beneath the window's sill when not on display. The system comprises a compartment fitted with an opening and having a bottom and plurality of interconnected side walls. The compartment is positionable beneath the surface of the sill, the sill having an aperture arranged in registration with the opening providing access to the compartment. The aperture and the compartment are sized to receive and store the object, which could comprise a decorative candle, for example.

The invention further comprises a movable cover positionable in registration with the aperture to enclose the compartment. The object is stored out of sight within the compartment beneath the surface of the sill and is conveniently removed from the compartment and positioned for display in the window as desired.

Display of the object is preferably accomplished by means of a support surface pivotally mounted within the compartment. The support surface is pivotable between a first position oriented angularly to the surface of the sill within the compartment and a second position substantially co-planar with the surface of the sill. Means for holding the support surface in the second position are provided, for example, in the form of a latch mounted on the support surface. The latch is movable into interengagement with the sill to hold the support surface in the coplanar second position. Another form of holding means used comprises a biasing spring mounted within the compartment engaging and biasing the support surface to the second position.

The object is interengagable with the support surface and is displayed in the window when the support surface is in the second position.

When the object to be displayed is a candle, it preferably has a base portion and an elongated taper portion. One end of the taper portion interengages one end of the base portion and is supported in a substantially upright position on the base portion. The other end of the base portion is interengagable with the support surface and positions the candle substantially perpendicularly thereto. The candle is displayed in a substantially upright position in the window when the support surface is in the second position.

To facilitate positioning of the candle for proper display in the window, an elongated slot is arranged in the support surface substantially lengthwise to the sill. A projection extends from the other end of the base portion to slidably interengage the slot. Means for retaining the base portion to the support surface are mounted on the projection. The candle is, thus, slidably movable lengthwise along the window sill guided by the slot for positioning the candle at a predetermined location in the window, for example, to center it. The candle is retained to the support surface at the location by the retaining means.

For elongated items, such as candles, it may be preferable to have the candle breakdown into two separate parts to conserve storage space and allow the candle to fit in a relatively small compartment. To effect this feature, the base portion of the candle preferably comprises a well located at the one end, the well being sized to receive and support the taper portion in the substantially upright position. The taper portion is separable from the base portion and both pieces are storable within the compartment when the taper portion is detached from the base portion.

The candle can be of the traditional wax variety or, for safety, is preferably an electric candle. The electric candle has a receptacle located in the other end of the taper portion, the receptacle being sized to receive an electrically powered light. Power is preferably provided via an electrically conductive pathway which extends from the receptacle through the candle to a source of electricity and can comprise, for example, a wire arranged either internally or externally to the wall in which the window is located.

The movable cover for the display and storage system has several practical embodiments and can comprise something as simple as a removable plate which lies in registration with the aperture co-planar with the sill or even flush with its surface. Other possible examples include a plate slidably mounted on the sill, the plate being slidable into and out of registration with the aperture to respectively enclose or expose the compartment. Alternately, the cover comprises a pair of elongated guide tracks arranged on opposite side walls of the compartment, the guide tracks having a first leg arranged adjacent to the aperture substantially co-planar with the sill, a second leg arranged substantially perpendicularly to the surface of the sill. A curved connecting portion of track joins the first and second legs. A flexible resilient plate forms the cover and has oppositely arranged edge portions slidably mounted within the guide tracks. The plate is slidable in the manner analogous to a roll top desk along the guide tracks from the first leg to the second leg and back, thereby moving the plate into and out of registration with the aperture. The plate bends flexibly when the edges traverse the curved connecting portions of the track.

It is an object of the invention to provide a means for conveniently storing an object in a window near to where the object will be displayed.

It is another object of the invention to provide a means for displaying the object in the window.

It is yet another object of the invention to provide a means for storing the object which is substantially unobtrusive when the object is in storage.

These and other objects of the invention will become apparent upon consideration of the following drawings and detailed description of the preferred embodiment of the invention.

BRIEF DESCRIPTION OF THE DRAWINGS

FIG. 3 shows a top plan view of the system shown in FIG. 2;

FIG. 4 shows a top plan view of the system shown in FIG. 2;

FIG. 10 shows a top plan view of a third alternate embodiment of the system shown in FIG. 2;

FIGS. 11 and 11A each show a partial cross-sectional view taken along lines 11 and 11A respectively of FIG. 10;

DETAILED DESCRIPTION OF THE PREFERRED EMBODIMENT

Figure 1:
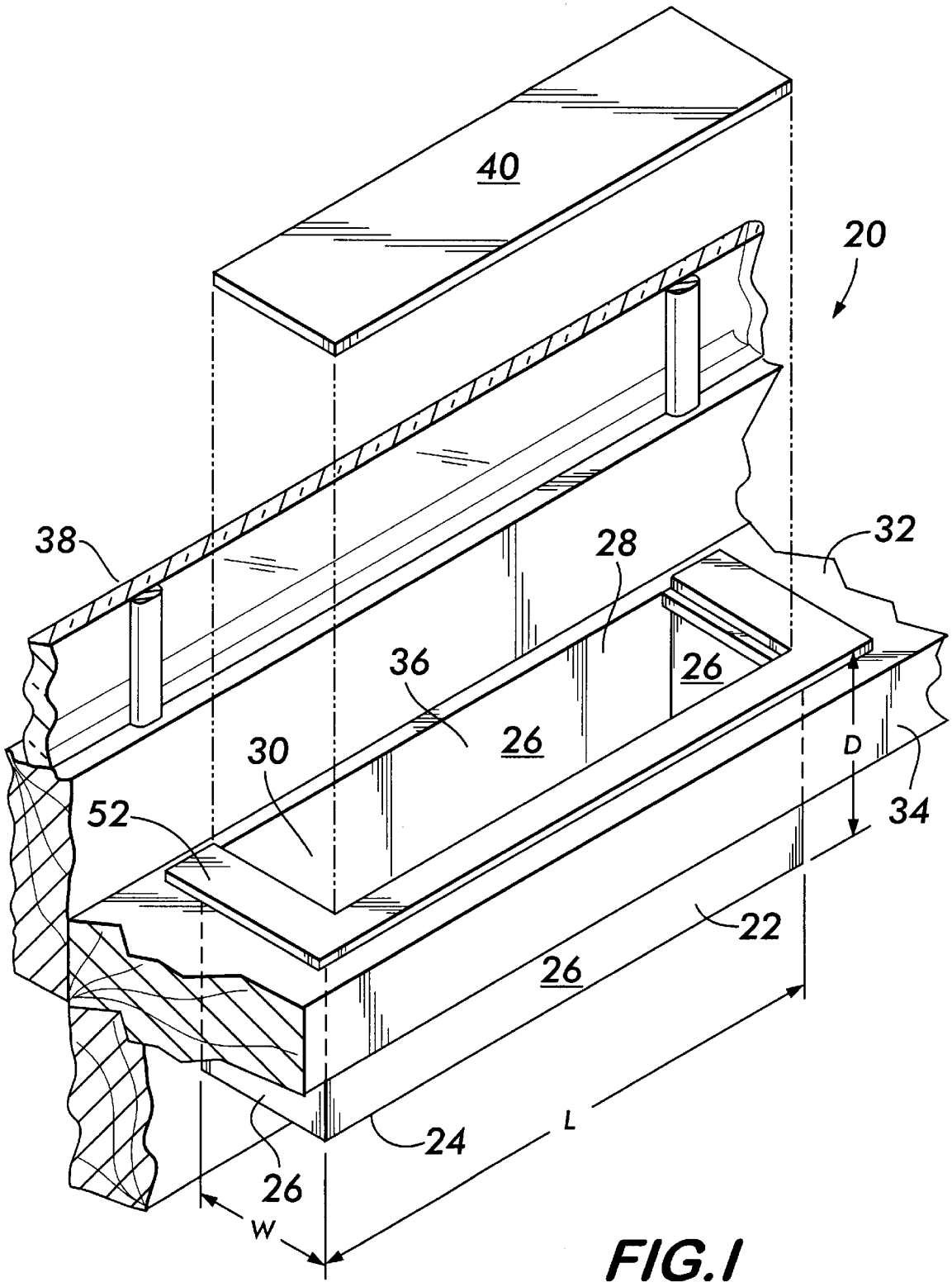
FIG. 1 shows a perspective view of the system for displaying and storing an object according to the invention.

FIG. 1 shows a perspective view of the display and storage system 20 according to the invention. System 20 comprises a compartment 22 defined by a bottom 24 and a plurality of interconnected side walls 26. Compartment 22 is fitted with an opening 28 permitting access to the interior 30.

Compartment 22 has a length "L" relatively greater than its width "W" or depth "D" and is is adapted to be positioned beneath the surface 32 of a window sill 34 substantially parallel lengthwise to the sill as shown in FIG. 1. Sill 34 has an aperture 36 arranged in registration with opening 28 providing access to the interior 30 of compartment 22. The aperture 36, opening 28 and compartment 22 are sized to receive and store an object which can be displayed in window 38.

A cover 40 is provided to enclose compartment 22. Cover 40 is movable into and out of registration with aperture 36 in a position substantially co-planar with the sill's upper surface 32 as illustrated in FIG. 1. In an alternate embodiment, the cover is mounted flush with the sill surface to present a substantially continuous sill and hide the presence of the compartment. The form of the cover may assume one of several embodiments, such as the simple removable plate depicted in FIG. 1, or others described below.

Figure 2:
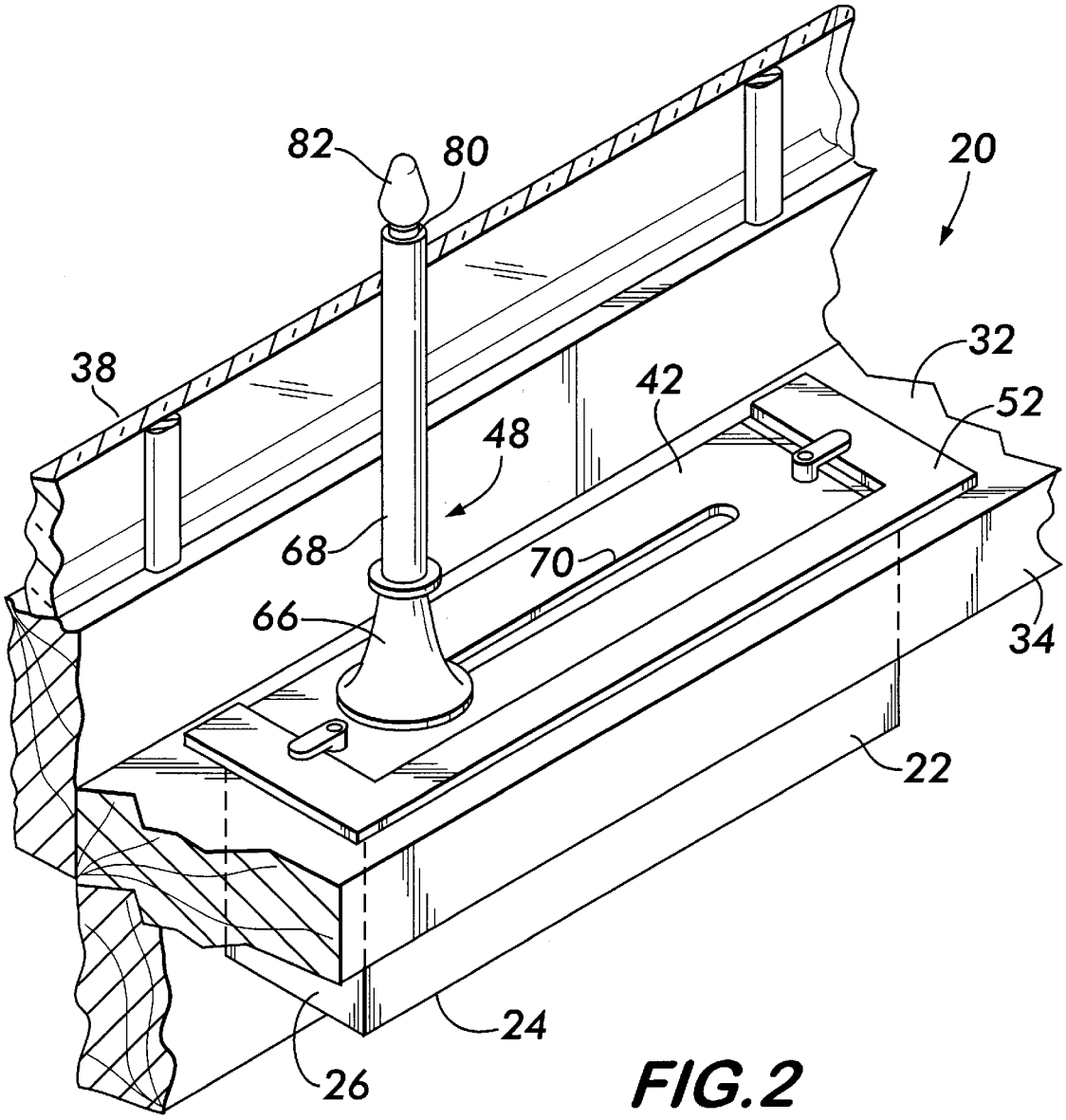
FIG. 2 shows a perspective view of an alternate embodiment of the system shown in FIG. 1.
Figure 6:
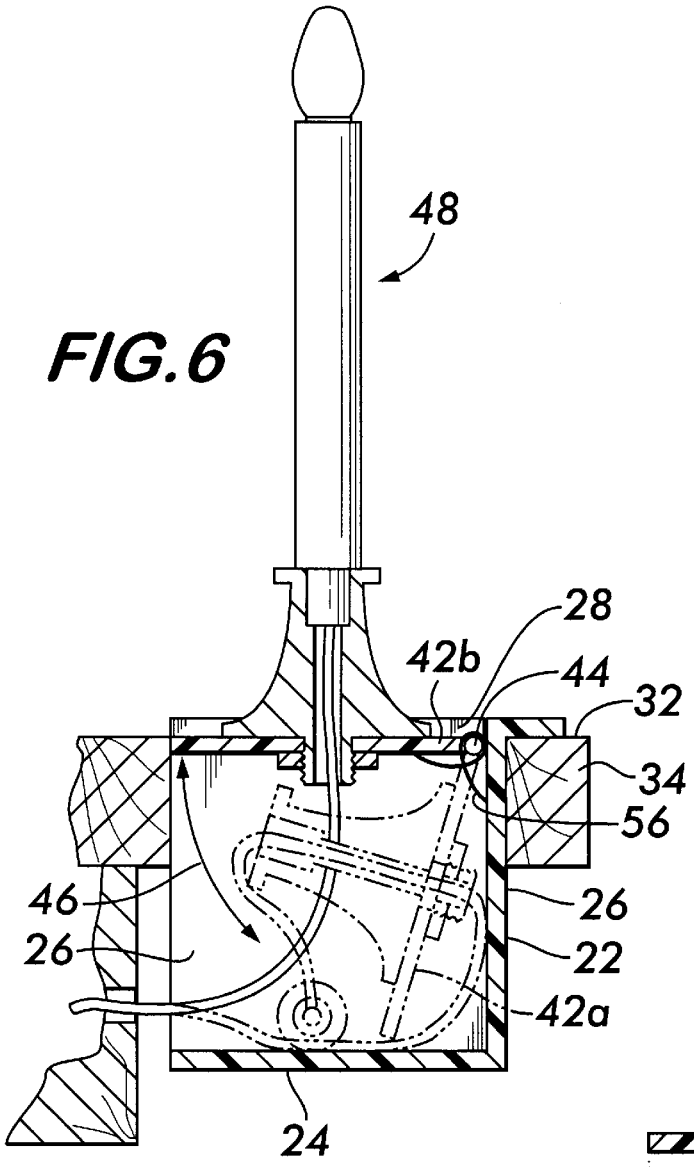
FIGS. 6 and 7 show related cross-sectional views of an alternate embodiment of the system shown in FIG. 2 taken along lines 6—6 and 7—7 of FIGS. 3 and 4 respectively.
Figure 7:
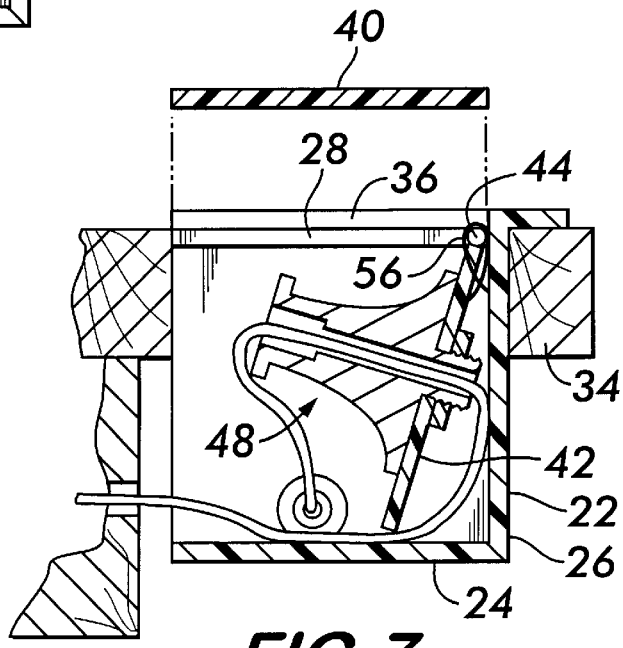

In the preferred embodiment seen in FIG. 2, a support surface 42 is pivotally mounted within compartment 22. As best illustrated in FIG. 6, support surface 42 is pivotally mounted by means of a hinge 44 arranged lengthwise of sill 32 adjacent to the opening 28 of compartment 22. Hinge 44 allows support surface 42 to pivot as indicated by arrow 46 between a first position, illustrated in broken line and denoted 42*a*, wherein the support surface is oriented angularly to the sill's surface 32 within compartment 22, and a second position, shown in solid line and denoted as 42*b*, wherein the support surface is substantially co-planar with the sill's surface. As shown in FIGS. 4 and 7, the object to be displayed, for example, the candle 48, is interengagable with the support surface 42 for storage within compartment 22. To display the object, the cover 40 is removed from registration with aperture 36 (FIG. 7) exposing the interior 30 of compartment 22 allowing access to the object (FIG. 4). The support surface 42 is then pivoted to bring it in its co-planar position with sill surface 32.

To maintain the support surface in the co-planar position, means for holding the support surface are provided, preferably in the form of latches 50 as shown in FIGS. 3 and 4. Latches 50 are movably mounted on support surface 42 and are brought into interengagement with sill 34 or a part of the compartment such as flange 52 (when present) as indicated by arrows 54 in FIG. 3. The latches hold support surface 42 into the co-planar position allowing the object to be displayed on the support surface in window 38.

While latches 50 are shown as rotatably movable, it is recognized that the actual design of the latches could take any practical form, for example, be slidably movable or rotatable out of the plane of the sill to effect the holding function.

FIGS. 6 and 7 illustrate an alternate embodiment for holding support surface 42 into the co-planar position by the use of a biasing spring 56 which is preferably mounted with hinge 44. Biasing spring 56 engages support surface 42 and a side wall 26 and pushes the support surface away from the side wall, causing the support surface to pivot about hinge 44 and move into the co-planar position when cover 40 is removed from compartment 22.

Although a spiral spring is shown as the holding means, in FIGS. 6 and 7, is it understood that virtually any type of structure which acts as a spring, i.e., which stores energy elastically when deflected, could serve as the holding means for the support surface.

While cover 40 has been shown as removable, in the preferred embodiment, the cover is arranged as an integral part of the system and remains with the compartment in the sill 34. FIGS. 10, 11 and 11A illustrate the preferred arrangement wherein cover 40 is slidably mounted just beneath the surface 32 of sill 34 on shoulders 58 (FIG. 11A) and linearly movable out of registration with aperture 36 to expose the interior 30 of compartment 22 as seen in FIG. 10.

Figure 8:
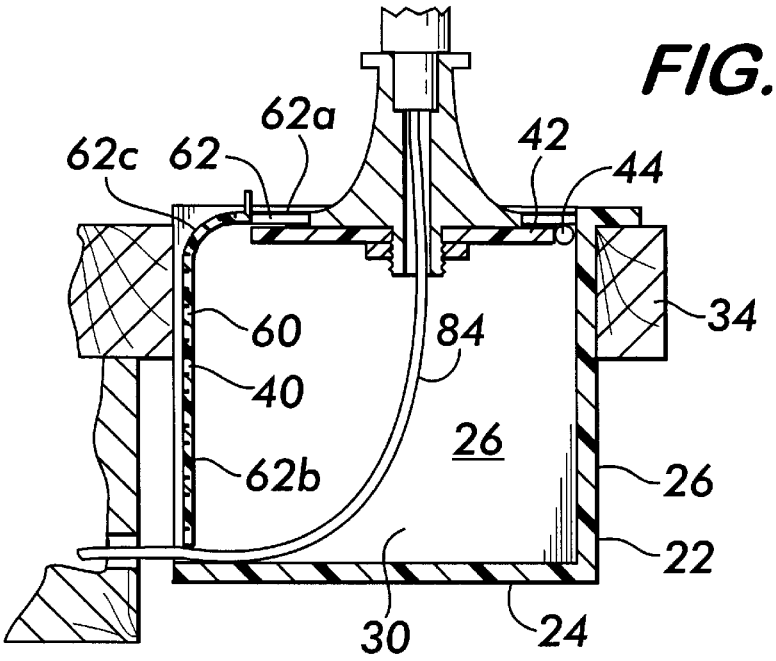
FIGS. 8 and 9 show related cross-sectional views of a second alternate embodiment of the system shown in FIG. 2.
Figure 9:
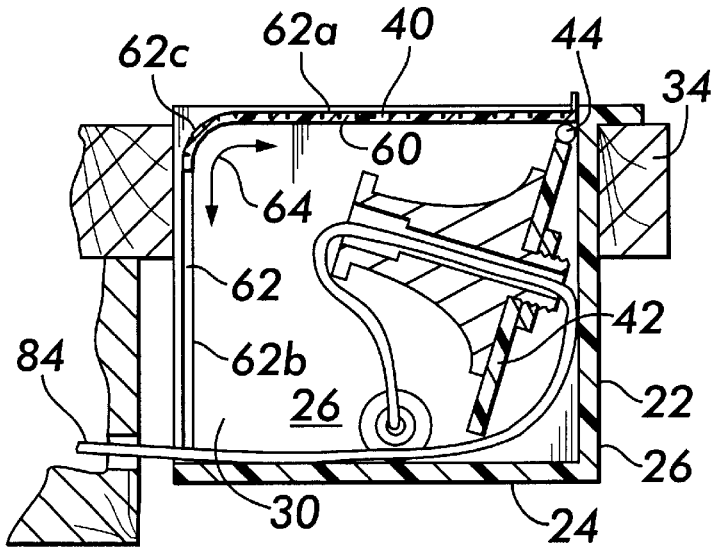

FIGS. 8 and 9 illustrate an alternate cover arrangement wherein cover 40 comprises a flexible resilient plate having oppositely arranged edge portions 60 (only one being shown). Edge portions 60 are slidably mounted within guide tracks 62 arranged in opposite side walls 26 of compartment 22. Guide tracks 62 comprise a first leg 62*a* arranged adjacent to aperture 36 substantially co-planar with sill 34, and a second leg 62*b* arranged substantially perpendicularly to the sill's surface 32. A curved connecting portion 62*c* joins the first and second legs. Cover 40 is slidable along guide tracks 62 as illustrated by arrow 64 in FIG. 9 from the first leg 62*a* to the second leg 62*b* and back, thereby moving cover 40 into and out of registration with aperture 36 to expose or cover interior 30 of compartment 22. Cover 40, being a flexible plate, readily bends in the manner of a cover for a roll top desk when edges 60 traverse curved connecting portion 62*c*.

Figure 5:
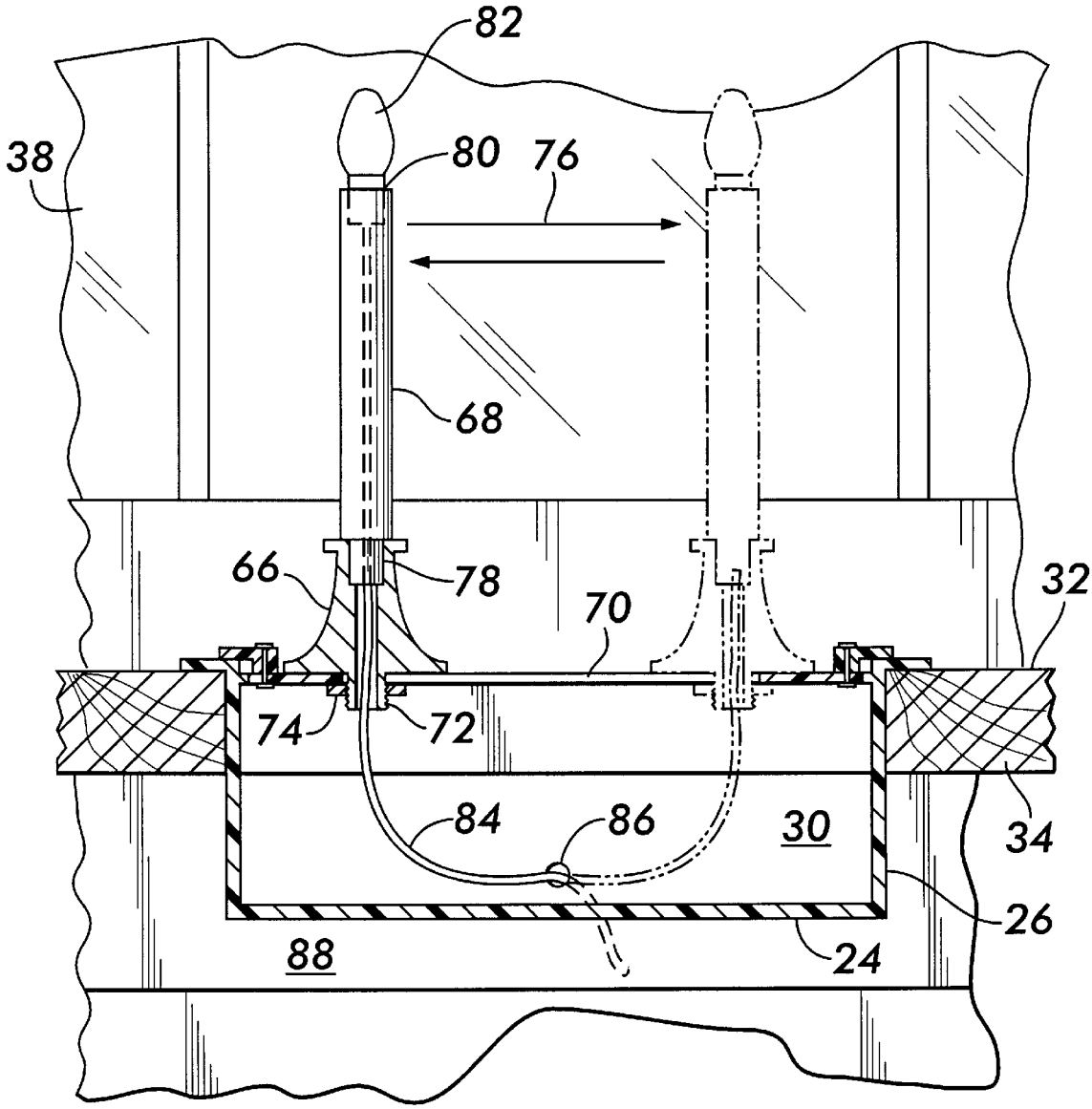
FIG. 5 shows a longitudinal cross-sectional view of the system shown in FIG. 2 taken along line 5—5 of FIG. 3.

Although the display and storage system according to the invention can be adapted to accept a wide variety of objects, in the preferred embodiment, the object for display and storage is candle 48 shown in FIG. 2. Preferably, candle 48 has a base portion 66 and a taper portion 68. The term "taper" is used here to generally describe the elongated portion of the candle which fits into the base and does not imply or suggest that this portion actually has a tapered shape. Base portion 66 engages support surface 42, which preferably has a slot 70 arranged substantially lengthwise to sill 34. As shown in FIG. 5, base portion 66 has a projection in the form of threaded nipple 72 extending from an end to engage slot 70 and extend through support surface 42. Threaded nut 74 engages nipple 72 and provides a means for retaining the candle to the support surface. Slot 70 allows candle 48 to move lengthwise along sill 34 as indicated by arrows 76 in FIG. 5 so that the candle can be positioned in the center of window 38.

It is preferable that the taper portion 68 be detachable from the base portion 66 of candle 48 as shown in FIG. 4. A disassembled candle requires less storage space than a fully assembled candle and thus allows the compartment 22 to have a practical size allowing it to readily fit in sill 34 and store the taper portion 68 in a substantially horizontal orientation. Base portion 66 has a well 78 (see FIG. 4) which is sized to receive an end of the taper portion and support the candle in window 38 in a substantially upright position as shown in FIGS. 2 and 5.

While conventional wax candles are contemplated as within the scope of the invention, it is preferred for safety and convenience to use electrical candles. FIG. 5 shows an electric candle taper portion 68 which has a receptacle 80 at one end sized to receive an electrically powered light 82. Wire 84 forming an electrically conductive pathway extends from light 82 through the candle to a source of electrical power. Preferably, wire 84 exits compartment 22 through an aperture 86 into the wall 88 beneath the window 38 where the wire can be connected directly to a junction box (not shown) hidden within the wall. This avoids unsightly exposed wires extending to electrical receptacles usually associated with electric candle displays in windows.

Figure 12:
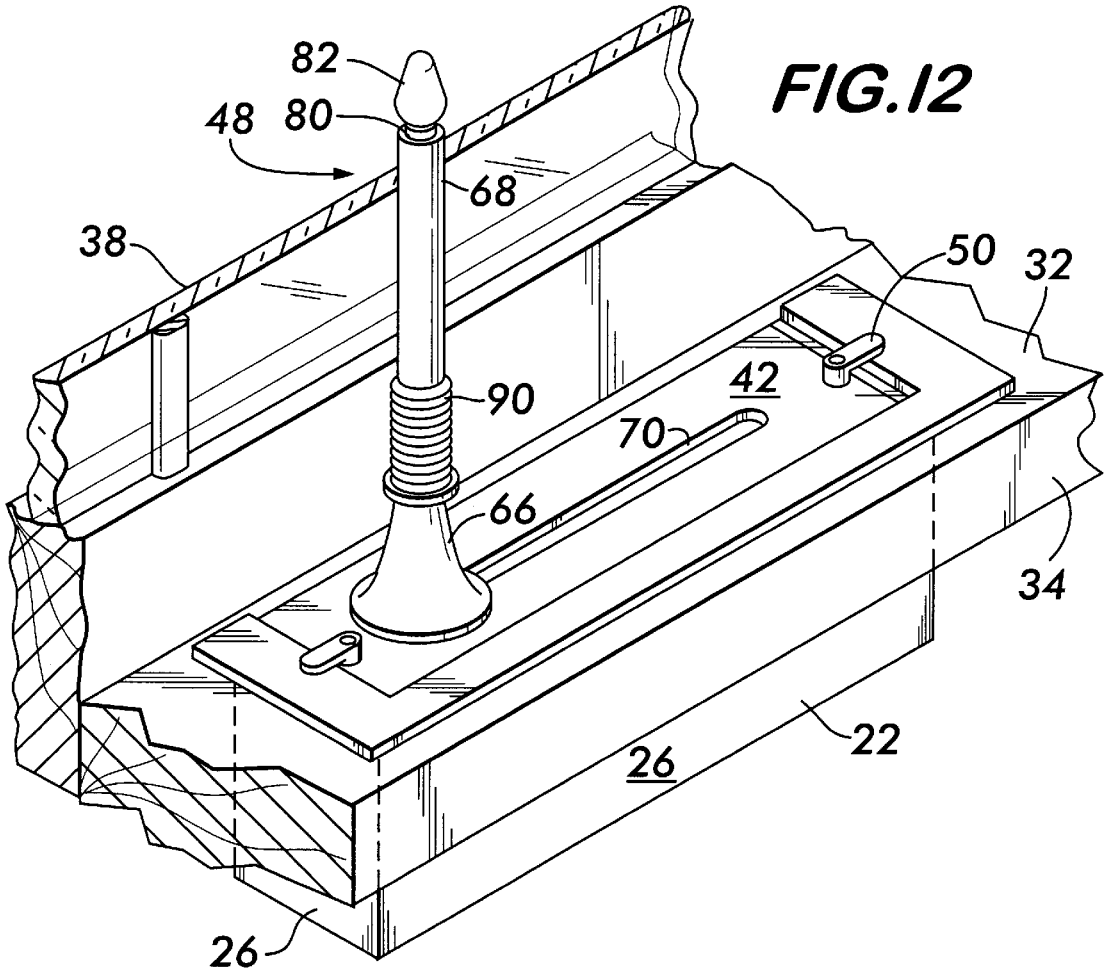
FIG. 12 shows a perspective view of a fourth alternate embodiment of the system shown in FIG. 2.
Figure 13:
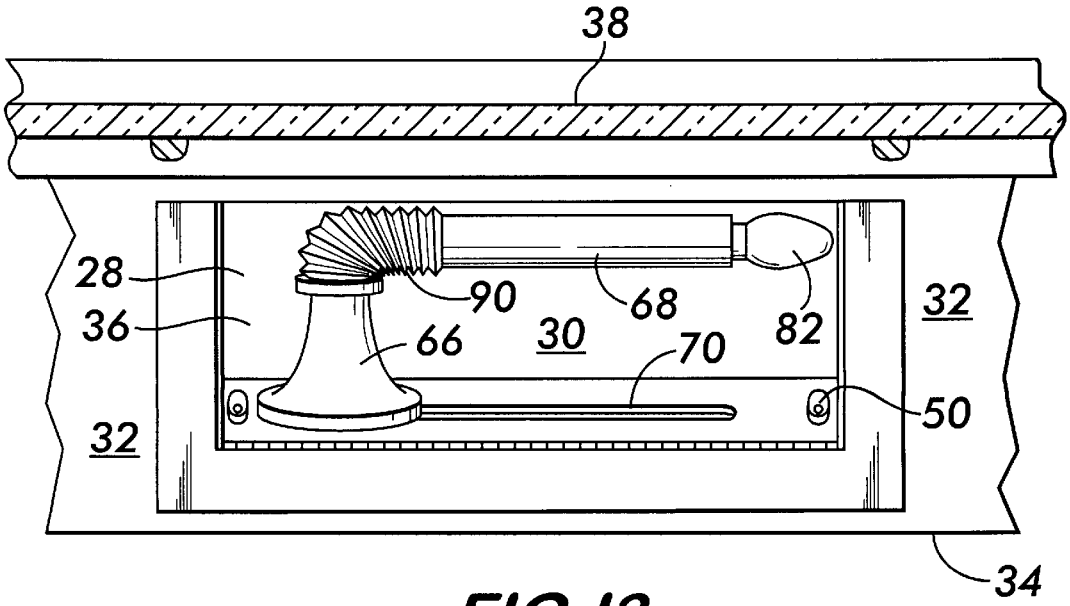
FIG. 13 shows a top plan view of the embodiment shown in FIG. 12.

FIGS. 12 and 13 illustrate an electric candle having an elongated flexible tubular segment 90 connected coaxially between base portion 66 and taper portion 68. Segment 90 maintains the taper portion in attachment with the base portion while allowing the taper portion to bend relative to the base portion when stored in compartment 22 as seen in FIG. 13. Segment 90 covers wire 84 which would otherwise be exposed when the taper portion is detached from the base portion for storage (see FIG. 4).

The display and storage system according to the invention provides a device for conveniently storing objects near where they will be repeatedly displayed and avoids the additional work associated with remote storage and retrieval of the objects. Decorative objects used to celebrate a holiday or a birthday or to advertise products or services are ideally suited for use with the system, but other more utilitarian applications are also contemplated as being within the scope of the invention.

What is claimed is:

1. A display and storage system for displaying an elongated object in a window and storing the object beneath the window's sill in a substantially horizontal orientation, said system comprising:

a compartment fitted with an opening and having a bottom and a plurality of interconnected side walls, said compartment having a length relatively greater than its depth or width and being positionable substantially parallel lengthwise to said sill beneath the surface thereof;

an aperture arranged in said sill in registration with said opening and providing access to said compartment, said aperture and said compartment being sized to receive and store said object;

a movable cover positionable in registration with said aperture to enclose said compartment;

said object being storable within said compartment beneath the surface of said sill in said substantially horizontal orientation, said object being removable from said compartment and positionable for display in said window.

2. A display and storage system according to claim 1, further comprising:

a support surface pivotally mounted within said compartment, said support surface being pivotable between a first position oriented angularly to the surface of said sill within said compartment, and a second position substantially co-planar with the surface of said sill;

means for holding said support surface in said second position; and said object being interengagable with said support surface and being displayed in said window when said support surface is in said second position.

3. A display and storage system according to claim 2, wherein said holding means comprises a latch mounted on said support surface and movable into interengagement with said sill to hold said support surface in said second position.

4. A display and storage system according to claim 2, wherein said holding means comprises a spring mounted within said compartment and engaging and biasing said support surface to said second position.

5. A display and storage system according to claim 2, wherein said object comprises a candle having a base portion and an elongated taper portion, one end of said taper portion interengaging one end of said base portion and being supportable in a substantially upright position on said base portion, the other end of said base portion being interengagable with said support surface and positioning said candle substantially perpendicularly thereto, said candle being displayed in said substantially upright position in said window when said support surface is in said second position.

6. A display and storage system according to claim 5, further comprising:

an elongated slot arranged in said support surface substantially lengthwise to said sill;

a projection extending from the other end of said base portion, said projection being sized to slidably interengage said slot; and means for retaining said base portion to said support surface mounted on said projection, said candle being slidably movable lengthwise along said window sill guided by said slot for positioning said candle at a predetermined location in said window and retained to said support surface at said location by said retaining means.

7. A display and storage system according to claim 6, wherein said base portion comprises a well located at said one end, said well being sized to receive and support said taper portion in said substantially upright position, said taper portion being separable from said base portion and storable within said compartment when detached from said base portion.

8. A display and storage system according to claim 7, said system being useable with an electrically powered light and further comprising:

a receptacle located in the other end of said taper portion, said receptacle being sized to receive said electrically powered light; and an electrically conductive pathway extending from said receptacle through said candle to a source of electricity for powering said light.

9. A display and storage system according to claim 8, further comprising an elongated flexible tubular segment having a first end connected coaxially to said one end of said taper portion and a second end connected coaxially to said one end of said base portion, said segment maintaining said taper portion in attachment with said base portion when said taper portion is removed from interengagement with said base portion thereby allowing said taper portion to be angularly positioned relative to said base portion for storage within said compartment.

10. A display and storage system according to claim 1, wherein said cover comprises a plate slidably mounted on said sill, said plate being slidable into and out of registration with said aperture to respectively enclose or expose said compartment.

11. A display and storage system according to claim 1, further comprising:

a pair of elongated guide tracks arranged on opposite side walls of said compartment, said guide tracks having a first leg arranged adjacent to said aperture substantially co-planar with said sill, a second leg arranged substantially perpendicularly to the surface of said sill, and a curved connecting portion joining said first and second legs; and a flexible resilient plate comprising said cover, said plate having oppositely arranged edge portions slidably mounted within said guide tracks, said plate being slidable along said guide tracks from said first leg to said second leg and back thereby moving said plate into and out of registration with said aperture, said plate flexibly bending when said edges traverse said curved connecting portions.

12. A device for storing an object beneath a window sill, said object being displayable in said window, said device comprising:

a compartment having a plurality of interconnected side walls and an open top, said compartment having a length relatively greater than its depth or width and being mountable beneath said sill in substantially lengthwise alignment therewith, said sill having an aperture in registration with said top permitting access to said compartment, said aperture and said compartment being sized to receive said object; and a movable cover positionable in registration with said aperture for enclosing said compartment, said cover being movable out of registration with said aperture to expose said compartment and permit said object to be removed from and stored within said compartment.

13. A device for storing an object according to claim 12, further comprising:

a movable support surface mounted within said compartment, said support surface being movable between a first position substantially within said compartment and a second position substantially coplanar with said sill;

means for holding said support surface in said second position; and means for attaching said object to said support surface positioned on said support surface, said object being displayed in said window when said support surface is in said second position.

14. A device for storing an object according to claim 13, wherein said support surface is pivotally mounted on one of said side walls adjacent to said aperture for pivotal movement between said first and second positions.

15. A device for storing an object according to claim 13, wherein said holding means comprises a spring mounted within said compartment and engaging said support surface for biasing and holding said support surface in said second position.

16. A device for storing an object according to claim 14, wherein said object comprises a candle and said means for attaching said candle to said support surface comprises an elongated slot positioned in said support surface and oriented lengthwise to said sill, said candle having a base positionable on said support surface, said base having a threaded stud extending therefrom sized to interengage said slot, said stud having a mating nut which can be tightened on said stud to clamp said support surface between said base and said nut thereby retaining said candle to said support surface.

17. A device for storing an object according to claim 12, wherein said cover comprises a plate slidably mounted on said sill, said plate being slidable into and out of registration with said aperture to respectively enclose or expose said compartment.

* * * * *